US006203396B1

(12) United States Patent
Asmussen et al.

(10) Patent No.: US 6,203,396 B1
(45) Date of Patent: Mar. 20, 2001

(54) MAGNETICALLY COUPLED MANNEQUIN JOINT

(75) Inventors: Christopher J. Asmussen, Glenwood Landing, NY (US); David Didur, Toronto (CA); Roger S. Friedman, Brooklyn, NY (US); Christopher Krecisz, Mississauga (CA)

(73) Assignee: Bernstein Display, New York, NY (US)

( * ) Notice: Subject to any disclaimer, the term of this patent is extended or adjusted under 35 U.S.C. 154(b) by 0 days.

(21) Appl. No.: 09/503,145

(22) Filed: Feb. 15, 2000

(51) Int. Cl.[7] ..... A63H 3/46
(52) U.S. Cl. ..... 446/376; 446/268; 446/390
(58) Field of Search ..... 446/268, 369, 446/372, 375, 376, 378, 379, 381, 383, 390; 40/411, 418, 419

(56) References Cited

U.S. PATENT DOCUMENTS 628,239 * 7/1899 Cohn ..... 446/376
1,552,348 * 9/1925 Rosenthal ..... 446/369
3,168,227 * 2/1965 Osmond ..... 446/376
5,052,971 * 10/1991 Young ..... 446/376

* cited by examiner

*Primary Examiner*—Sam Rimell
(74) *Attorney, Agent, or Firm*—Milbank, Tweed, Hadley & McMcloy LLP

(57) ABSTRACT

A magnetically coupled mannequin joint is provided which includes a first portion and a second portion which is rotatably movable about the axis of the first portion and slidably movable along that axis. The first portion and the second portion may be secured in a position where the first portion and the second portion are substantially secured in a direction parallel to the axis by magnetic attraction. The first portion and the second portion have joint surfaces which interfit with each other such that, from said secured position, rotation of the second portion about the axis simultaneous with sliding the second portion parallel to the axis moves the joint to a position where the first portion and the second portion are substantially unsecured.

19 Claims, 5 Drawing Sheets

MAGNETICALLY COUPLED MANNEQUIN JOINT

BACKGROUND

1. Field of the Invention

The present invention relates to magnetically coupled joints for mannequins and forms.

2. Description of the Related Art

Using the form of the human body for displaying clothing is well known. The forms used might be full mannequins, clothing forms (not the full body), or shapers which shape only a section of the garment to that of the three dimensional human form. It is also known to connect various segments of a doll, mannequin, or form through the use of a magnetic coupling at joints between these segments.

Prior art non-magnetic mechanical joints, which are common in the industry, use a key-and-slot or bayonet type connection which require inserting a pin extending from one segment of the mannequin into a hole in another segment of the mannequin and then rotating the segments with respect to each other to secure the joint.

Prior art magnetically coupled mannequin joints have included a male portion having a projection of generally circular shape which fits into a female portion having a corresponding receptacle. A permanent magnet and a ferromagnetic material (such as iron or steel), or a pair of magnets having surfaces with opposite polarities, are laced so that surfaces of the male and female portions of the joint, which are generally perpendicular to the axis of the cylinder, are held in contact by magnetic attraction.

In one prior art magnetically coupled joint, a magnet is placed at the bottom surface of a generally oval receptacle, and a ferromagnetic plate is placed on the face of a generally oval projection. The joint is disassembled by pivoting one portion with respect to the other about an axis generally parallel to the mating surface of the joint. In this way, the respective portions of the joint may not be rotated with respect to each about an axis perpendicular to the mating surfaces without first moving the two joint portions in a direction other than that of the joint axis. This prior art method of operation requires angled joint surfaces which are complex and difficult to machine. In addition, this prior art device and method increases the chance of pinching the garment when assembling or disassembling the joint. Because this prior art system requires manipulation in a manner unlike the more common key-and-slot or bayonet type mannequin joints, users are unlikely to be able to detect when a positive connection has been made.

Therefore, it is desirable to provide a magnetically coupled mannequin joint in which the above mentioned disadvantages are substantially overcome.

SUMMARY OF THE INVENTION

A magnetically coupled mannequin joint embodying the present invention has a first portion and a second portion which is rotatably movable about the axis of the first portion and slidably movable along that axis. The first portion and the second portion may be secured in a position where the first portion and the second portion are substantially secured in a direction parallel to the axis by magnetic attraction. The first portion and the second portion have joint surfaces which interfit with each other such that, from said secured position, rotation of the second portion about the axis simultaneous with sliding the second portion parallel to the axis moves the joint to a position where the first portion and the second portion are substantially unsecured.

DETAILED DESCRIPTION OF THE DRAWINGS

Figure 1:
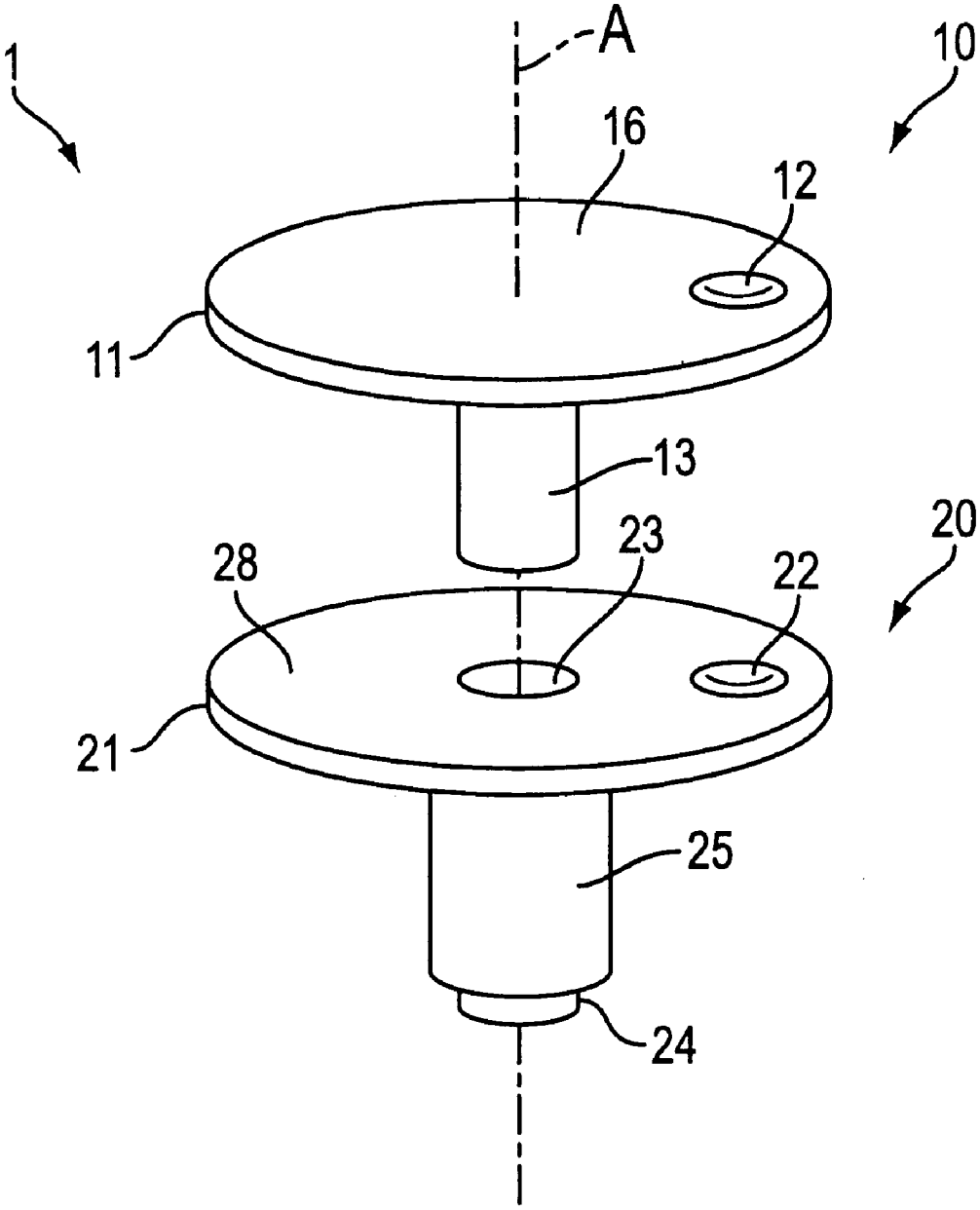
FIG. 1 is an exploded isometric view of a male and female portion of a magnetically coupled mannequin joint which illustrates aspects of the invention.
Figure 2:
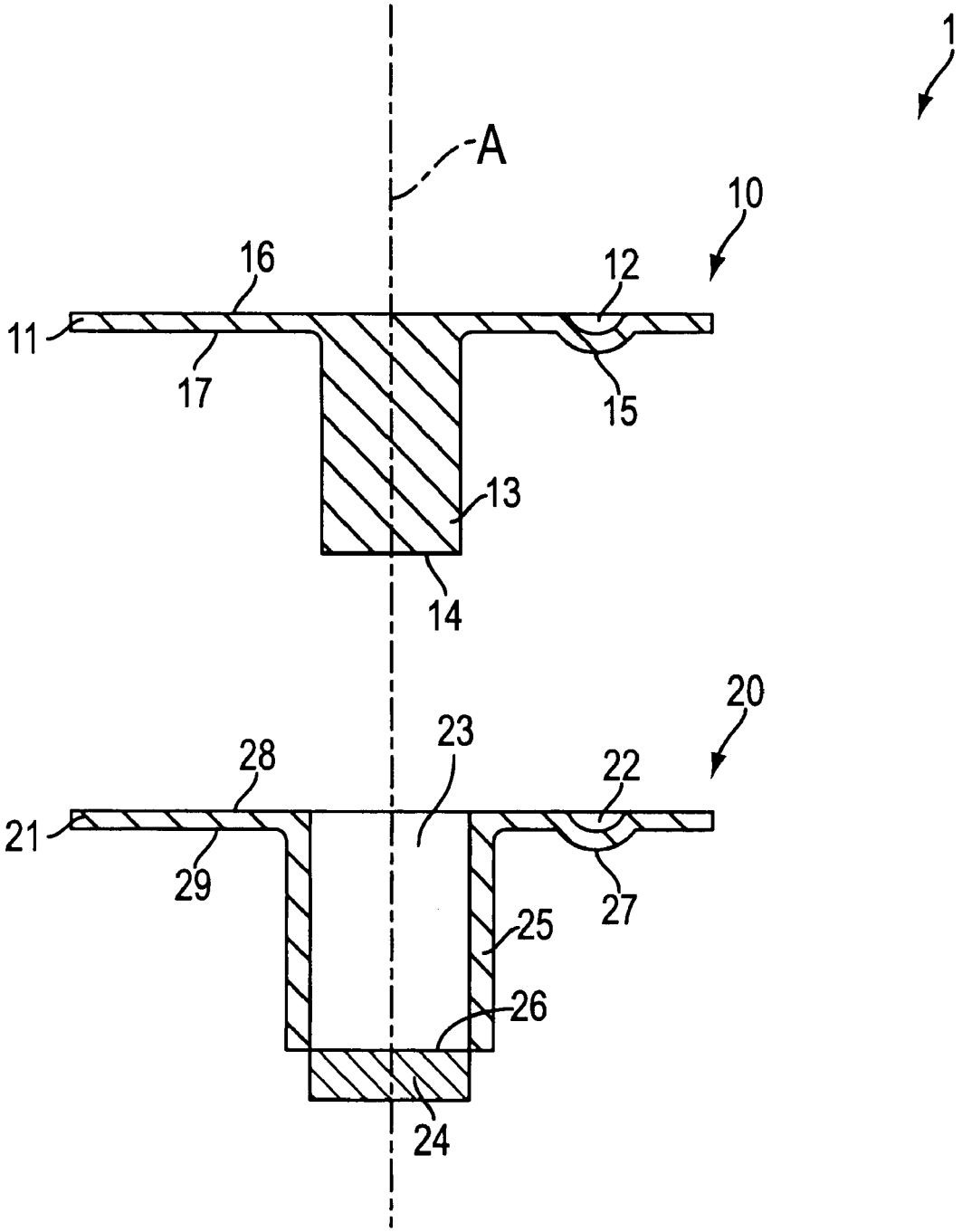
FIG. 2 is an exploded cross-section view of a male and female portion of a magnetically coupled mannequin joint which illustrates aspects of the invention.

FIG. 1 is an exploded isometric view, and FIG. 2 is an exploded cross-section view, of a male portion 10 and female portion of a magnetically coupled mannequin joint 1 which illustrates aspects of the invention.

Male portion 10 is made up of male flange plate 11 and male circular projection 13. Male flange plate 11, which has posterior surface 16 and anterior surface 17, is generally flat except for a male dimple 12 in posterior male flange plate surface 17 and a corresponding male indexing projection 15 which extends from the male flange plate anterior surface 17. Male circular projection 13 perpendicularly extends from the male flange plate anterior surface 17, and includes, at its anterior end, ferromagnetic surface 14 parallel to male flange plate anterior surface 17. Male circular projection 13 may or may not be centered within the edge contour of male flange plate anterior surface 17.

Similarly, female portion 20 is made up of female flange plate 11, female circular projection 25, and rare-earth magnet 24. Female flange plate 21, which has anterior surface 28 and posterior surface 29, is generally flat except for a female indexing dimple 22 in female flange plate anterior surface 28 and a corresponding female projection 27 which extends from the female flange plate posterior surface 29. Female circular projection 25 perpendicularly extends from the female flange plate posterior surface 29, and magnet 24 is mounted at the posterior end of female circular projection 25 so that magnet surface 26 is parallel to female flange plate 21. Circular receptacle 23, which is included within female circular projection 25, may or may not be centered within the edge contour of female flange plate anterior surface 28. Circular receptacle 23 having a diameter slightly larger than the diameter of male circular projection 13 so that male portion 10 and female portion 20 may be slidably and rotatably moved with respect to each other when male circular projection 25 is inserted into circular receptacle 23. In addition, female indexing dimple 22 is sized to be slightly larger than male indexing projection 15, and dimple 22 and projection 15 are located at similar radial distances from the axes of circular receptacle 23 and male circular projection 13. Furthermore, circular receptacle 23 has a length slightly longer than the diameter of male circular projection 13 so that ferromagnetic surface 14 does not contact magnet surface 24 when male portion 10 and female portion 20 are positioned so that male circular projection 13 is inserted into circular receptacle 23, male indexing projection 15 is inserted into female indexing dimple 22, and the flat portion of male flange plate anterior surface 17 contacts the flat portion of female flange plate anterior surface 28.

To connect the joint 1, male portion 10 and female portion 20 are positioned so that the axis of male circular projection 25 and the axis of circular receptacle 23 are aligned along an axis A. Male circular projection 25 is then inserted into circular receptacle 23. The magnetic attraction between ferromagnetic surface 14 and magnet 24 will begin to draw male portion 10 and female portion 20 together until the male indexing projection 15 contacts female flange plate anterior surface 28. Male portion 10 and female portion 20 are then rotated with respect to each other around axis A until male indexing projection 15 is inserted into female indexing dimple 22, and the flat portion of male flange plate anterior surface 17 contacts the flat portion of female flange plate anterior surface 28. In this alignment, joint 1 is rotatably secured (e.g., by the insertion of male indexing projection 15 into female indexing dimple 22) and axially secured (e.g., by the maximized magnetic attraction between ferromagnetic surface 14 and magnet 24).

To disconnect the joint 1, a torque about axis A is applied to either male portion 10 or female portion 20 while the other portion is restrained. Simultaneously, male indexing projection 15 is rotatably ejected from female indexing dimple 22, and the flat portion of male flange plate anterior surface 17 is separated from the flat portion of female flange plate anterior surface 28 in a direction parallel to axis A. Joint 1 is thus simultaneously unsecured both rotatably and axially, as the magnetic attraction between ferromagnetic surface 14 and magnet 24 will be lessened from the secured position. Joint 1 may then be completely disassembled by withdrawing male circular projection 25 from circular receptacle 23 along axis A.

By means of a mechanism of this type, it is possible to disconnect a strongly-secured magnetically coupled mannequin joint without pivoting the joint around an axis other than the joint axis, or applying direct force in a direction parallel to the joint axis.

Figure 3:
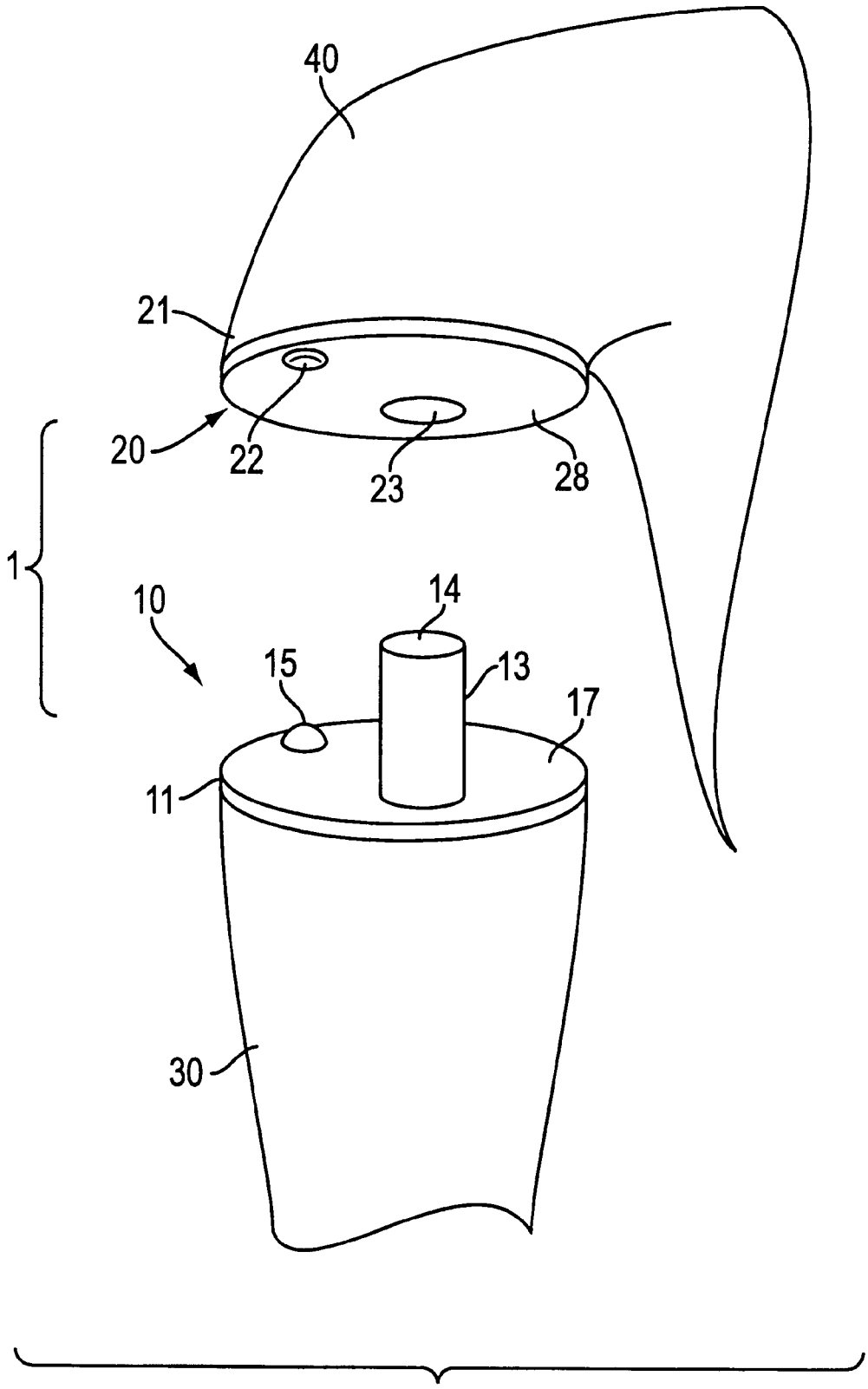
FIG. 3 illustrates a detail of a mannequin shoulder joint embodying aspects of the invention.

FIG. 3 illustrates a detail of a mannequin shoulder joint, having magnetically coupled mannequin joint 1 mounted between mannequin torso 40 and mannequin arm 30, which embodies aspects of the invention. Male portion 10 is mounted so that the posterior surface 16 (not shown) of male flange plate 11 is attached to the shoulder end of mannequin arm 30. Similarly, female portion 10 is mounted so that the posterior surface 29 (not shown) of male flange plate 11 is attached to the shoulder of mannequin torso 40. To connect arm 30 with torso 40, arm 30 (and thus male portion 10) is positioned with respect to torso 40 (and thus female portion 20) as described above until male indexing projection 15 is pulled into female indexing dimple 22 by the magnetic attraction between the portions 10, 20 of joint 1, and the flat portion of male flange plate anterior surface 17 simultaneously contacts the flat portion of female flange plate anterior surface 28. In this alignment, arm 30 is rotatably and axially secured to torso 40. Arm 30 is disconnected from torso 40 by applying a torque to arm 30 (and thus male portion 10) with respect to fixed torso 40 (and thus female portion 20) as described above, ejecting male indexing projection 15 from female indexing dimple 22, and simultaneously separating the flat portion of male flange plate anterior surface 17 from the flat portion of female flange plate anterior surface 28. Arm 30 and torso 40 are thus simultaneously unsecured both rotatably and axially, and arm 30 may then be withdrawn from torso 40.

Figure 4:
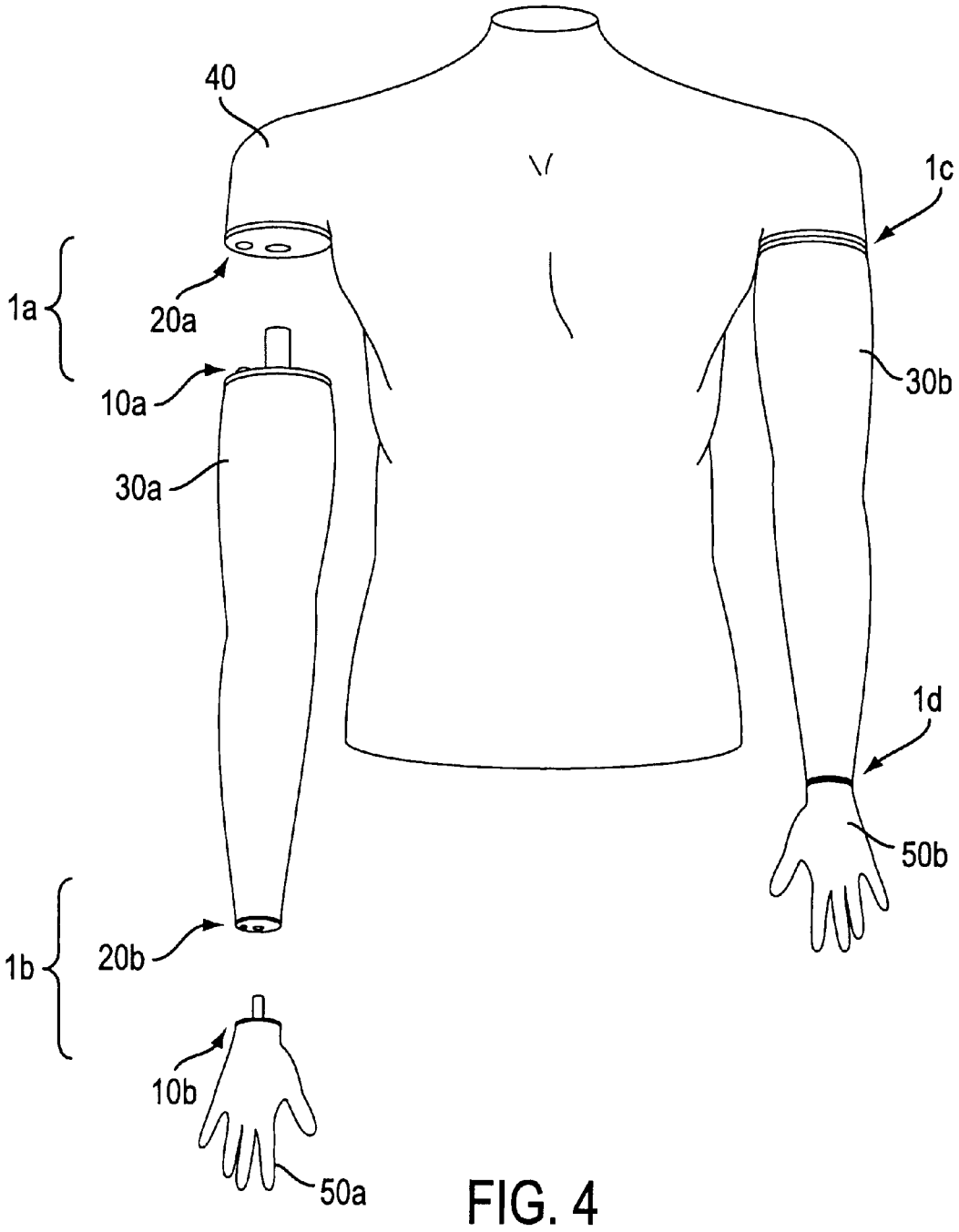
FIG. 4 illustrates a mannequin embodying aspects of the invention.

FIG. 4 illustrates a partial-body mannequin embodying aspects of the invention at the shoulder and wrist joints. Right shoulder joint la between mannequin torso 40 and mannequin right arm 30a, shown disassembled, includes male portion 10a mounted to right arm 30a and female portion 20a mounted to torso 40. Similarly, right wrist joint lb between mannequin right arm 30a and mannequin right hand 50a, shown disassembled, includes male portion 10a mounted to right hand 50a and female portion 20a mounted to right arm 30a. Left shoulder joint 1c between mannequin torso 40 and mannequin left arm 30b, and right wrist joint 1d between mannequin right arm 30b and mannequin right hand SOb, are shown in the assembled position.

Figure 5:
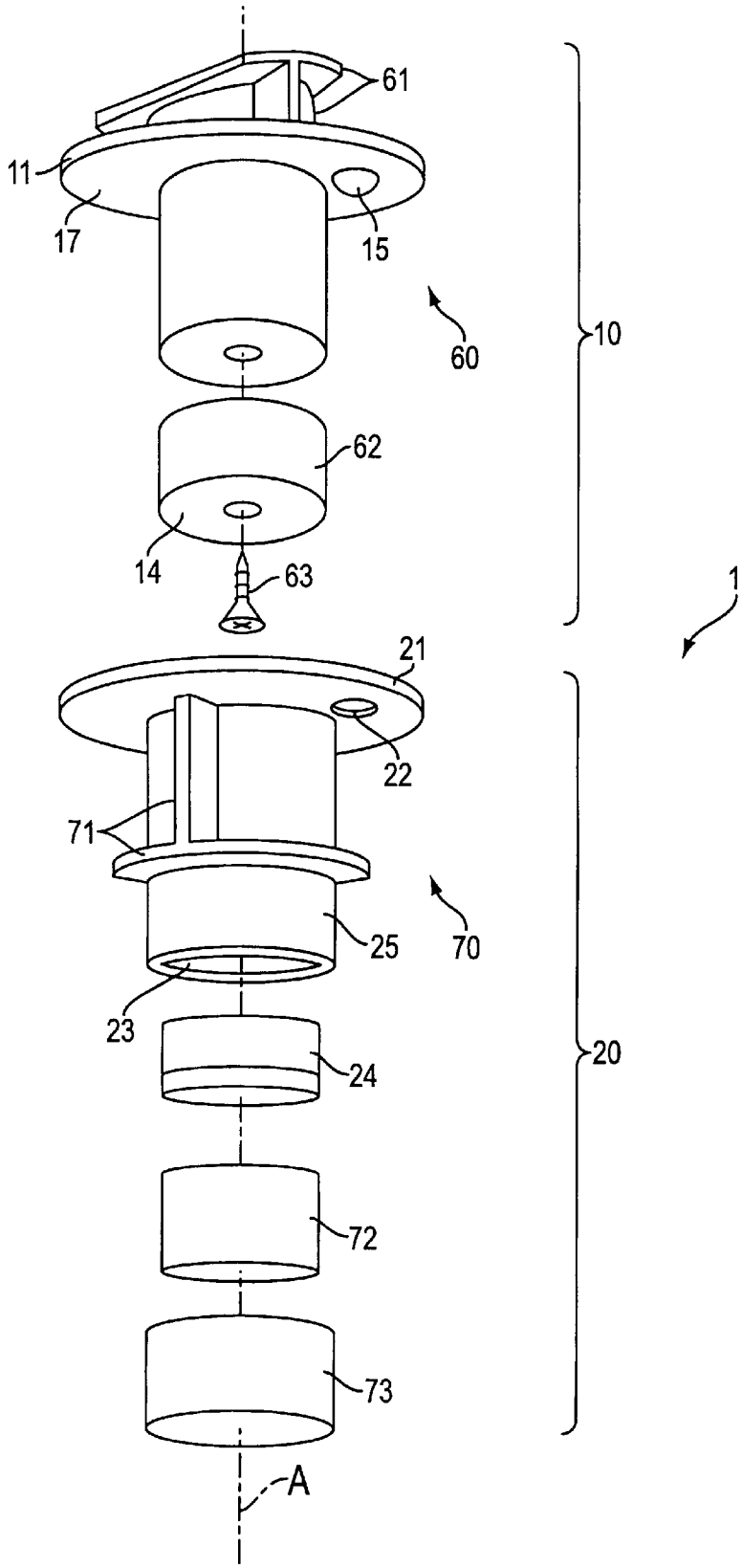
FIG. 5 is an exploded isometric view of a preferred embodiment of a magnetically coupled mannequin joint of the present invention.

In a preferred embodiment of a magnetically coupled mannequin joint 1, illustrated in FIG. 5, male portion 10 is made up of male base 60, male cylinder 62, and screw 63, while female portion 20 is made up of female base 70, magnet 24, female cylinder 72, and retaining cup 73. Male base 60 is preferably constructed of acetal plastic and integrally includes male flange 11, male circular projection 13, male indexing projection 15, and male molding projections 61. Similarly, female base 70 is preferably made of acetal plastic and integrally includes female flange 21 having female indexing dimple 22 therethrough, female circular projection 25, and female molding projections 71. Indexing dimple 22 and indexing projection 15 are located approximately 1.25 in. from the axes of the circular projection 13 and circular receptacle 23. Indexing dimple 22 is preferably of semi-spherical shape, is approximately 0.5 in. in diameter and extends approximately 0.2 in. from flange plate exterior surface 17. Indexing dimple 22 preferably has circular shape and angled walls, and extends through female flange plate 21. Flange plates 11 and 21 preferably have circular edge contours of approximately 3.0 in. diameter. Preferably, cylindrical projection 13 and receptacle 23 are located in the center of circular flange plates 11 and 21 respectively. Preferably, circular receptacle 23 has a diameter of approximately 0.8 in., and is approximately 1.8 in. long. Male cylinder 62, which includes ferromagnetic surface 14, is preferably made of mild steel and attached to male circular projection 13 by screw 63. Magnet 24 is preferably composed of a rare-earth magnetic material, and is approximately 0.8 in. diameter by 0.4 in. high. Magnet 24 is preferably loaded in from the bottom of female circular projection 25 against a ring-shaped ledge formed in receptacle 23, and is secured in place by female cylinder 72 (preferably formed of mild steel), and retaining cup 73. Retaining cup 73 is preferably formed of nylon and forms a tight fit over female circular projection 25. Male portion 10 and female portion 20 are preferably fixed to, for example, arm 30 and torso 40 by molding portions 10, 20 into the material of arm 30 and torso 40. In such a molded attachment, the material of arm 30 and torso 40 is flowed around molding projections 61, 71.

In a joint of one embodiment of the invention, flange plates 11 and 21 are formed of sheet metal, and dimples 12 and 22 (and corresponding projections 15 and 27) are punched into these flange plates. Flange plates 11 and 21 may conform to the shape of the exterior contour of the mannequin at the joint.

In a joint of another embodiment of the invention, the male circular projection 13 may be generally frustum-shaped so that it tapers from a maximum diameter at the male flange plate anterior surface 17 to a minimum diameter at ferromagnetic surface 14, and receptacle 23 may be similarly tapered from a maximum diameter at female flange plate anterior surface 28 to a minimum diameter at magnet surface 26 so that male portion 10 is wedged into female portion 20 when projection 15 is inserted into dimple 22.

In a joint of a further embodiment of the invention, the end of male circular projection 13 may be chamfered.

In a joint of a still further embodiment of the invention, the positions of ferromagnetic surface 14 and magnet 24 are reversed, i.e., ferromagnetic surface 14 is at the posterior end of circular receptacle 23 of female circular projection 25, and magnet 26 is located at the anterior end of male circular projection 13. In a yet further embodiment, ferromagnetic surface 14 is a magnet having the opposite polarity to magnet 24.

In a joint of another embodiment of the invention, indexing projection 12 may have a cross section which is approximately a segment of a circle or ellipse when intersected by a plane which is parallel to the axis of the circular projection 13 and perpendicular to a radial line extended from the axis to projection 12, and may have a radial cross-section of a different (e.g., triangular, trapezoidal, rectangular) shape. In such an embodiment, indexing dimple 22 would have a corresponding shape.

In a joint of still another embodiment of the invention, female flange plate 28 may include a plurality of indexing dimples 22, each located at a similar distance from the axis of receptacle 23, which allows male portion 10 to be radially and axially secured to female portion 20 in a corresponding plurality of rotational positions. In yet another embodiment, the positions of indexing projection 15 and indexing dimple 22 are reversed, i.e., indexing projection 15 extends from female flange plate anterior surface 28, and indexing dimple 22 is in male flange plate anterior surface 17.

In another embodiment, flange plates 11, 21 may be angled with respect to the axis A of receptacle 23 and circular projection 13.

In still another embodiment, ferromagnetic surface 14 and magnet surface 26 may be angled with respect to the axis A receptacle 23 and circular projection 13.

In a further embodiment, male flange plate anterior surface 17 may be formed of a ferromagnetic material, and female flange plate anterior surface 28 may be wholly or partially formed of a magnet, or the positions of the magnet and ferromagnetic materials may be reversed.

In a mannequin of another embodiment of the invention, the respective male and female flange plate sizes, circular projection sizes, receptacle sizes, and the location of the male indexing projections and female indexing dimples of each joint may be varied from joint to joint.

In a mannequin of yet another embodiment of the invention, a magnetically coupled joint as described above may be placed at locations which may or may not correspond to the wrist, elbow, shoulder, ankle, knee, hip, waist, neck, or other joint associated with the human anatomy, or may be placed between a mannequin and a stand, pedestal, hanger, or other mannequin support structure known to those in the art.

It is to be understood that the above-described embodiments are merely illustrative of the principles of the invention and that other arrangements may be devised by those skilled in the art without departing from the spirit and scope of the invention.

What is claimed is:

1. A magnetically coupled mannequin joint comprising:

a first portion having an axis; and a second portion having a cylindrical projection, said second portion rotatably movable about said axis and slidably movable parallel to said axis, said first portion and said second portion having a secured position where said first portion and said second portion are engaged and substantially secured in a direction parallel to said axis by magnetic attraction, said first portion and said second portion having joint surfaces which interfit with each other such that, from said secured position, rotation of said second portion about said axis simultaneous with sliding said second portion in said direction parallel to said axis and along said cylindrical projection moves said joint to a position where said first portion and said second portion are substantially unsecured but continue to be engaged; and one of said first and second portions includes magnetic material.

2. The magnetically coupled mannequin joint of claim 1 wherein said first portion includes a first flat surface and a circular receptacle extending through said first flat surface; and said second portion includes a second flat surface and said cylindrical projection extends from said second flat surface.

3. The magnetically coupled mannequin joint of claim 2 wherein one of said flat surfaces includes at least one indexing projection; and the other of said flat surfaces includes an indexing dimple, said indexing projection and said indexing dimple intermitting with each other such that, from said secured position, rotation of said second portion about said axis ejects said indexing projection from said indexing dimple.

4. The magnetically coupled mannequin joint of claim 2 wherein said circular projection is tapered.

5. The magnetically coupled mannequin joint of claim 3 wherein a cross-section of said indexing projection is substantially a segment of a circle in cross-section.

6. The magnetically coupled mannequin joint of claim 5 wherein said indexing projection is substantially a segment of a sphere.

7. A mannequin for the display of clothing having the form of at least a portion of the human body for the display and having at least one magnetically coupled mannequin joint between a first mannequin part and a second mannequin part comprising:

a first portion having an axis coupled to the first mannequin part;

a second portion having a cylindrical projection coupled to the second mannequin part, said second portion rotatably movable about said axis and slidably movable parallel to said axis, said first portion and said second portion having a secured position where said first mannequin part and said second mannequin part are engaged and substantially secured in a direction parallel to said axis by magnetic attraction, and said first portion and said second portion having joint surfaces which interfit with each other such that, from said secured position, rotation of said second portion about said axis simultaneous with sliding said second portion in said direction parallel to said axis and along said cylindrical projection moves said joint to a position where said first mannequin part and said second mannequin part are substantially unsecured but continue to be engaged; and one of said first and second portions includes magnetic material.

8. The mannequin of claim 7 wherein said first portion includes a first flat surface and a circular receptacle extending through said first flat surface; and said second portion includes a second flat surface and said cylindrical projection extends from said second flat surface.

9. The mannequin of claim 8 wherein one of said flat surfaces includes at least one indexing projection; and the other of said flat surfaces includes an indexing dimple, said indexing projection and said indexing dimple interfitting with each other such that, from said secured position, rotation of said second portion about said axis ejects said indexing projection from said indexing dimple.

10. The mannequin of claim 7 wherein said mannequin corresponds to less than the complete form of the human body.

11. The mannequin of claim 7 wherein said joint is located at a position corresponding to a joint of the human anatomy.

12. The mannequin of claim 7 wherein one of said first mannequin part and said second mannequin part corresponds to a portion of the human anatomy, and the other one of said mannequin part and said second mannequin part is a mannequin support structure.

13. A magnetically coupled mannequin joint comprising:

a first portion having an axis, a first flat surface, a circular receptacle coaxial with said axis and extending through said first flat surface, and at least one indexing dimple; and a second portion having a second flat surface, a circular projection coaxial with said axis and extending from said second flat surface, and an indexing projection, said second portion rotatably movable about said axis and slidably movable parallel to said axis, said first portion and said second portion having a secured position where said first portion and said second portion are substantially secured in a direction parallel to said axis by magnetic attraction, and said first portion and said second portion are substantially secured in a direction perpendicular to said axis by the interfitting of said indexing projection with said indexing dimple.

14. The magnetically coupled mannequin joint of claim 13 wherein said circular projection is substantially cylindrical.

15. The magnetically coupled mannequin joint of claim 13 wherein said circular projection is tapered.

16. The magnetically coupled mannequin joint of claim 13 wherein said indexing projection is substantially circular.

17. The magnetically coupled mannequin joint of claim 13 wherein one of said flat surfaces of one of said portions is formed of a ferromagnetic material.

18. The magnetically coupled mannequin joint of claim 17 wherein the other one of said portions includes a magnet for attracting said flat surface formed of said ferromagnetic material.

19. The magnetically coupled mannequin joint of claim 13 wherein said first portion is coupled to a first mannequin part of a mannequin for the display of clothing having the form of at least a portion of the human body, and said second portion is coupled to a second mannequin part of said mannequin.

* * * * *